US011454024B2

(12) United States Patent
Line

(10) Patent No.: US 11,454,024 B2
(45) Date of Patent: Sep. 27, 2022

(54) STRUCTURAL OSB PANELS WITH INTEGRATED RAINSCREEN

(71) Applicant: LOUISIANA-PACIFIC CORPORATION, Nashville, TN (US)

(72) Inventor: Jarrod Kevin Line, Brentwood, TN (US)

(73) Assignee: LOUISIANA-PACIFIC CORPORATION, Nashville, TN (US)

( * ) Notice: Subject to any disclaimer, the term of this patent is extended or adjusted under 35 U.S.C. 154(b) by 0 days.

(21) Appl. No.: 16/275,571

(22) Filed: Feb. 14, 2019

(65) Prior Publication Data

US 2020/0141120 A1 May 7, 2020

Related U.S. Application Data

(60) Provisional application No. 62/630,359, filed on Feb. 14, 2018.

(51) Int. Cl.
*E04C 2/52* (2006.01)
*E04C 2/16* (2006.01)
*E04C 2/30* (2006.01)

(52) U.S. Cl.
CPC ..... *E04C 2/528* (2013.01); *E04C 2/16* (2013.01); *E04C 2/30* (2013.01)

(58) Field of Classification Search
CPC . E04C 2/528; E04C 2/326; E04C 2/16; E04C 2/30
USPC ..... 52/302.1, 302.3, 302.4
See application file for complete search history.

(56) References Cited

U.S. PATENT DOCUMENTS 2,248,233 A * 7/1941 Heritage ..... E04C 2/326 52/316
3,561,177 A * 2/1971 Argo et al. ..... E02B 3/126 52/309.4
6,786,013 B2 * 9/2004 Coulton ..... E04D 12/002 52/302.3
6,990,775 B2 * 1/2006 Koester ..... E04B 1/70 52/783.17

(Continued)

FOREIGN PATENT DOCUMENTS

DE 3329789 A1 3/1985

OTHER PUBLICATIONS

International Search Report and Written Opinion, PCT/US19/17949, Lousiana-Pacific Corp. (international filing date Feb. 14, 2019, WIPO Pub. Date Aug. 22, 2019).

*Primary Examiner* — Paola Agudelo
*Assistant Examiner* — Adam G Barlow
(74) *Attorney, Agent, or Firm* — Wayne Edward Ramage; Baker Donelson

(57) ABSTRACT

A plurality of rainscreen elements or features that are applied to the front or outer face of a structural panel or the weather resistant barrier layer on the structural panel. When an exterior cladding or sheathing product is installed over the structural panel, the rainscreen elements or features provide built-in water flow gaps or channels to facilitate and increase water drainage off the face of the structural panel, thereby minimizing water storage in the space between the structural panel and the outer cladding/sheathing. The rainscreen features are incorporated into the structural panel in-line or during the manufacturing process, and do not require any further work during assembly or construction on-site.

13 Claims, 3 Drawing Sheets

(56) References Cited

U.S. PATENT DOCUMENTS

D588,280 S * 3/2009 Gleeson ..... D25/163
D588,284 S * 3/2009 Gleeson ..... D25/163
D589,171 S * 3/2009 Gleeson ..... D25/163
8,769,894 B2 * 7/2014 Power ..... E04B 1/7076 52/302.1
9,057,196 B2 * 6/2015 Amend ..... E04F 15/02194
9,127,467 B2 * 9/2015 Johnson ..... E04B 2/845
9,394,696 B2 * 7/2016 Norwood ..... E04F 13/0864
D814,052 S * 3/2018 Darrow ..... D25/138
9,963,887 B2 * 5/2018 Norwood ..... E04B 1/7038
10,480,188 B2 * 11/2019 Power ..... E04F 13/0875
2009/0193738 A1 * 8/2009 Kortuem ..... E02D 31/02 52/302.1
2009/0320397 A1 * 12/2009 Hansbro ..... E04H 5/10 52/302.1
2010/0101159 A1 * 4/2010 Gleeson ..... E04B 1/66 52/302.1
2010/0199586 A1 * 8/2010 Martineau ..... E04B 1/7612 52/656.1
2010/0287864 A1 * 11/2010 Hatzinikolas ..... E04B 1/70 52/302.1
2014/0065349 A1 * 3/2014 Kwan ..... E04C 2/049 428/138
2015/0096249 A1 * 4/2015 Amend ..... E04B 1/66 52/510
2016/0319555 A1 11/2016 Norwood
2017/0210098 A1 * 7/2017 Moore ..... B32B 21/14
2017/0335567 A1 * 11/2017 Chugh ..... E04C 2/526
2019/0345713 A1 * 11/2019 Lolley ..... E04B 1/80

* cited by examiner

STRUCTURAL OSB PANELS WITH INTEGRATED RAINSCREEN

This application claims benefit of and priority to U.S. Provisional application No. 62/630,359, filed Feb. 14, 2018, which is incorporated herein in its entirety by specific reference.

FIELD OF INVENTION

This invention relates to a wood structural panel (such as oriented strand board, plywood, or other cellulistic panel) used for structural sheathing with integrated rainscreen feature and weather resistant barrier or layer.

BACKGROUND OF INVENTION

Building wall and roof assemblies are typically layers of several materials, each performing a single function, that are installed separately on the site in which the building is being constructed. Compatibility between the various layers creates challenges not only for the designer, but also for the installers. Combining layers requires a suitable base layer in which additional layers can be applied to create a single wall or roof layer that has multiple functions.

Light frame construction typically utilizes wood or manufactured wood structural panel sheathing (e.g. OSB or plywood) that is fastened to the wall framing. Oriented, multilayer wood strand boards are composed of several layers of thin wood strands, which are wood particles having a length which is several times greater than their width. These strands are formed by slicing larger wood pieces so that the fiber elements in the strands are substantially parallel to the strand length. The strands in each layer are positioned relative to each other with their length in substantial parallel orientation and extending in a direction approaching a line which is parallel to one edge of the layer. The layers are positioned relative to each other with the oriented strands of adjacent layers perpendicular, forming a layer-to-layer cross-oriented strand pattern. Oriented, multilayer wood strand boards of the above-described type, and examples of processes for pressing and production thereof, are described in detail in U.S. Pat. Nos. 3,164,511, 4,364,984, 5,435,976, 5,470,631, 5,525,394, 5,718,786, and 6,461,743, all of which are incorporated herein in their entireties by specific reference for all purposes.

Following the sheathing, a weather resistant barrier (WRB) system is installed around the building. Some products have a WRB layer on the sheathing. In high volume rain environments, a rainscreen system often is applied after application of the WRB. The rainscreen system provides an air space between the WRB layer and the exterior cladding. This allows drainage of rainwater that may pass through the exterior cladding and may otherwise become trapped between the cladding and WRB layer, thus providing extra protection for the structure, but adding to the cost and labor for construction.

SUMMARY OF INVENTION

In various exemplary embodiments, the present invention comprises a plurality of rainscreen components or features that are applied or affixed to the outer or front face of a WRB layer on a wood or manufactured wood structural panel, such as OSB ("oriented strand board"), plywood, or other cellulistic panel, used for structural sheathing.

The rainscreen component comprises a plurality of rainscreen features arranged on the outer face of the WRB layer or overlay. In several embodiments, the features comprise raised elements or ridges ⅛ to ¾ inches tall. The raised elements or ridges may alternative orientation every other element and every row, although different sizes, shapes, orientations, and patterns may be used.

The rainscreen features may be applied with the WRB during the manufacturing process, thereby eliminating the cost and time to apply WRB and/or rainscreen components in the field during construction. The integrated rainscreen component allows water to more easily drain and run off the structural panel behind the exterior sheathing (e.g., panel, brick, stucco, lap siding, and the like) applied to the outer surface of the structural panel/sheathing. The design of the rainscreen element also allows the structural panels to be stacked and shipped normally with no damage to the panels or rainscreen features.

DETAILED DESCRIPTION OF EXEMPLARY EMBODIMENTS

In various exemplary embodiments, the present invention comprises a wood or manufactured wood structural panel 4, such as OSB ("oriented strand board"), plywood, or other cellulistic panel, used for structural sheathing (e.g., the panel is mounted on one or more studs 2 or frame components of the building under construction). The panel is coated or layered with a weather/water resistive barrier (WRB) 6 of some kind, such as an overlay, during the manufacturing process. A rainscreen component is also applied during the manufacturing process, so that it is integrated with the WRB and/or structural panel.

Figure 1:
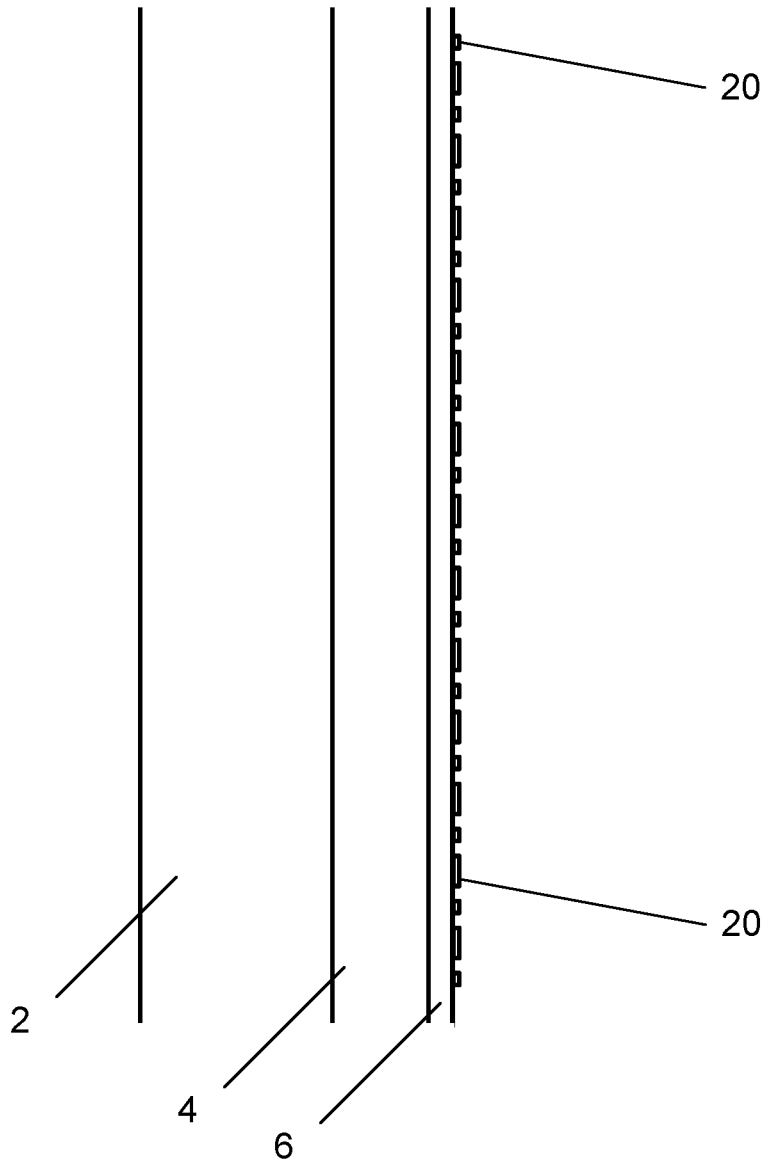
FIG. 1 shows a side view of a product in accordance with an embodiment of the present invention.
Figure 2:
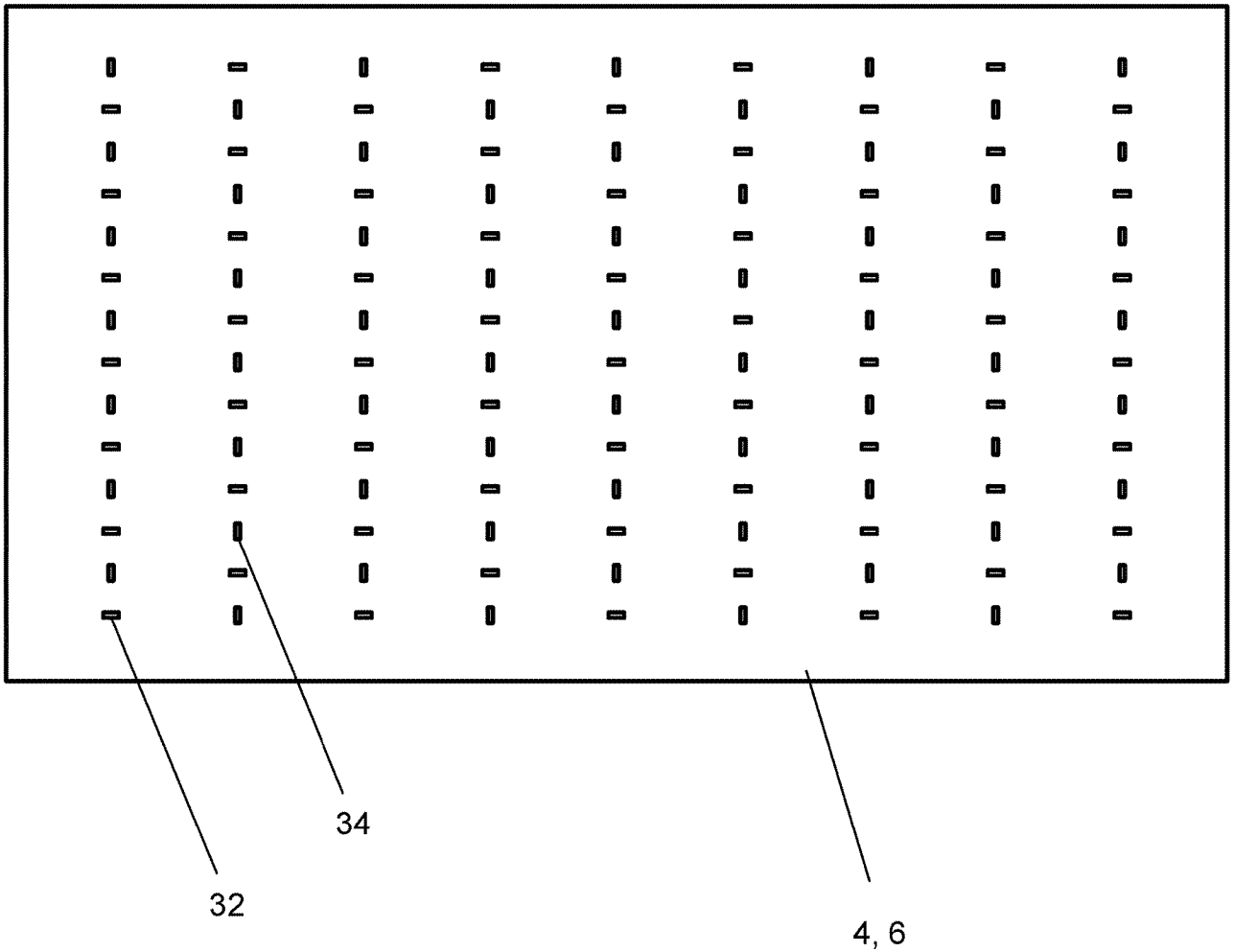
FIG. 2 shows a front view of the product of FIG. 1.

As seen in FIGS. 1-2, in one exemplary embodiment, the rainscreen component comprises a plurality of rainscreen features 20 arranged in rows and/or columns on the outer face of the WRB layer or overlay 6. In some embodiments, the rainscreen features may be affixed directly to the structural panel.

Figure 3:
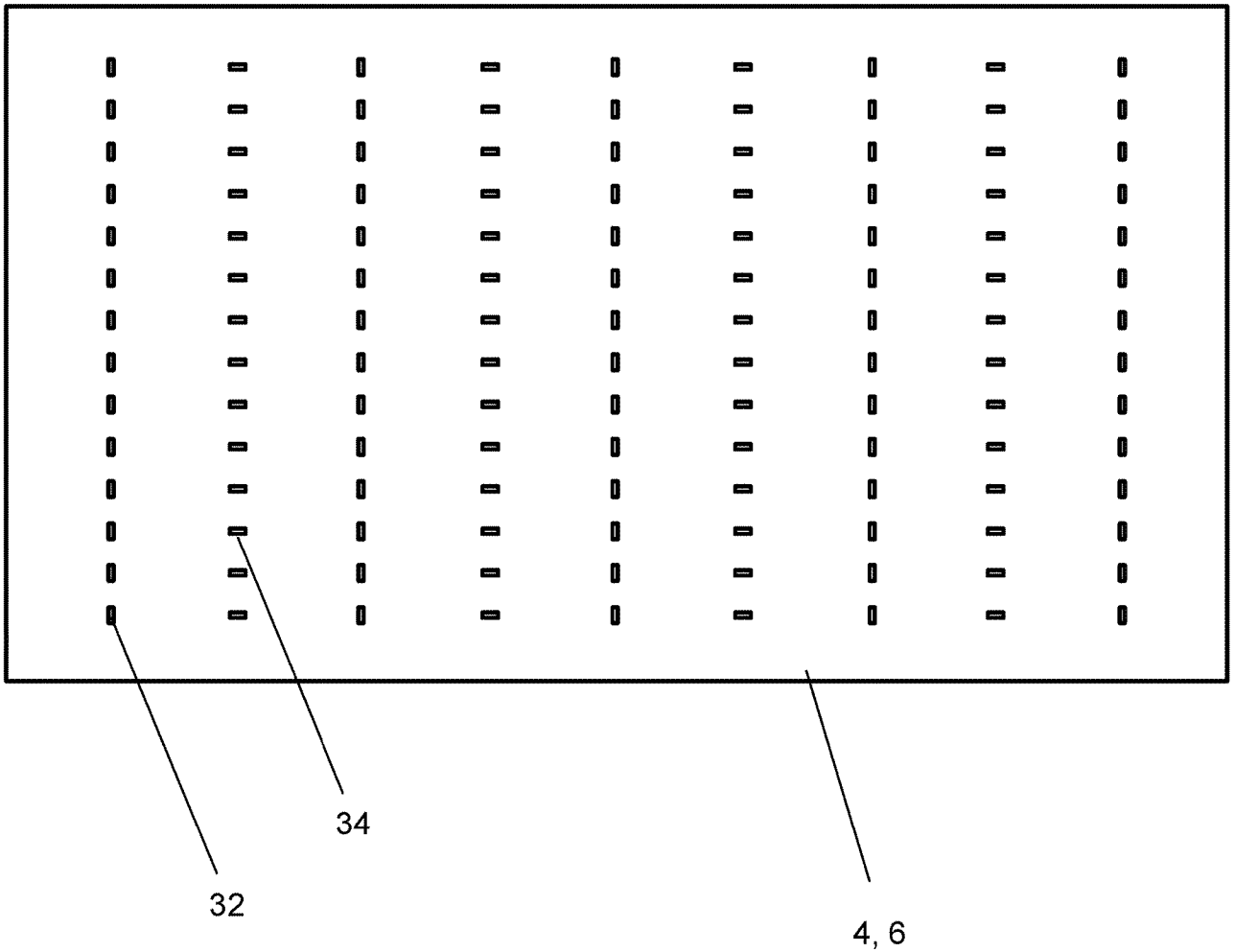
FIG. 3 shows a front view of a product with an alternative configuration of rainscreen components.

In the embodiment shown, the features comprise raised elements, strips, beads, or ridges ⅛ to ¾" tall, with alternating orientation 32, 34 every other element and/or every row, although different sizes, shapes, orientations, and patterns may be used, as seen in FIG. 3. In one embodiment, each raised feature 32, 34 is ¾" to 1" long, and ⅛" to ¾" high. When in linear form, the width of each element is less than the length, but generally not less than approximately 1/16" in width (e.g., in one embodiment, approximately ⅛" to ½" in width). The features shown here are linear, and extend lengthwise parallel to the upper or lower edges of the structural panel 4, although other shapes and alignments (e.g., one or more features parallel to one or more sides, at an angle to one or more sides, and so on) are possible.

These features provide for a plurality of fixed gaps and/or fluid channels between the outer face of the structural panel and the inner face of the exterior cladding/sheathing (e.g., panel, brick, stucco, lap siding, and the like) when assembled or applied to the outer surface of the structural panel. The rainscreen component thus allows water to more easily drain and run off the structural panel behind the exterior cladding/sheathing. The design of the rainscreen element also allows the structural panels to be stacked and shipped normally with no damage to the panels or rainscreen features.

The present invention possess several advantages over the prior art. It provides a savings in time and labor, as a secondary contractor is not needed to apply a WRB and a rainscreen after a structural/OSB panel is installed. Further, applying the WRB and rainscreen features to the panels in a controlled setting (e.g., manufacturing facility) allows the thickness of the WRB and rainscreen component to be consistently applied, and allows the WRB the opportunity to fully bond with the structural/OSB panel. More specifically, the WRB and the rainscreen components can be applied to a panel without interference from construction-related dirt, debris, humidity, or weather conditions. Further since the WRB and rainscreen elements are pre-applied to the panel it reduces the number of penetrations in the wall assembly installation process and therefore reduces air infiltration in the wall cavity. These enhancements increase system performance, installation reliability and structure durability while decreasing construction related waste. It also reduces the amount of individual components/SKUs and number of materials needed to be delivered and stored at a jobsite.

In additional embodiments, some or all of the rainscreen features or elements improve the product's ability to equilibrate (moisture-wise) before installation as well as after installation. Prior to installation, the rainscreen features or elements allow increased airflow between pieces of the product when stacked, thereby allowing accelerated equilibrium of the pieces of product in the middle or the interior of the stack (in the absence of the present invention, product in a stack will differentially equilibrate, as pieces of the product in the middle or the interior of the stack will not be exposed to air flow). Accelerated equilibrium minimizes the amount of expansion or contraction of the product after installation. This stabilization of the product provides greater ease and flexibility in installation and lower probability of post-installation issues such as, but not limited to, buckling, shrinkage, excessive vapor drive through the paint, and other similar issues.

The product can be manufactured using several different processes. Material can be attached to the front of the WRB creating a pattern of raised points that facilitate drainage. In several embodiments, as detailed herein, the pattern or patterns are not omnidirectional. Specific shapes of polymer or other materials can be applied. These shapes include, but are not limited to, thin and thick lines, ridges, or linear features of various lengths and angles, dots, circles and other shapes which impart certain properties. This process allow for shapes of various sizes and thicknesses to be applied to optimize cost and product performance. Polymer or other materials which could be applied include but not limited to heat sensitive materials, 2-part resins, and other forms of solid materials adhered to the panel or board. In various of the figures shown, the additive technologies add hard polymer shapes as rainscreen features across the face of the WRB layer on the panel to provide gaps between the panel and exterior cladding/sheathing when installed (or between adjacent panels in a pre-installation stack) for water drainage.

In one exemplary embodiment, a method of producing of producing the above-described product comprises the steps of:

producing wood strands;

treating some or all of the wood strands with chemicals or additives, or both;

forming, in a production line in a manufacturing facility, a mat with one or more layers from said treated wood strands;

applying, in said production line using a production press, heat and pressure to the mat to form a board with an inner surface and an outer surface;

applying, in said production line, a water resistant barrier to the outer surface;

applying, in said production line, a plurality of rainscreen features to the water resistant barrier opposite the outer surface of the board; and cutting the board to produce a finished structural panel.

The step of applying the water resistant barrier may comprise spraying, using one or more spray nozzles, a fluid or liquid membrane on the first surface or second surface, or both. The fluid or liquid membrane is sprayed on in a consistent thickness.

Thus, it should be understood that the embodiments and examples described herein have been chosen and described in order to best illustrate the principles of the invention and its practical applications to thereby enable one of ordinary skill in the art to best utilize the invention in various embodiments and with various modifications as are suited for particular uses contemplated. Even though specific embodiments of this invention have been described, they are not to be taken as exhaustive. There are several variations that will be apparent to those skilled in the art.

The invention claimed is:

1. A pre-manufactured integrated structural panel with integrated rainscreen, comprising:

a base layer with an inner surface and an outer surface, and a first edge and a second edge, wherein the second edge is orthogonal to the second edge;

at least one water resistant layer integrated with the base layer and substantially coating the outer surface; and a plurality of rainscreen features integrated with the at least one water resistant layer and arranged on the water resistant layer opposite the base layer, wherein said plurality of rainscreen features comprise a first type of raised linear element with a length and a width, wherein the length is greater than the width, with the length of the first type of raised linear element arranged parallel to the first edge of the base layer in a first orientation, and a second type of raised linear element with a length and a width, wherein the length is greater than the width, with the length of the second type of raised linear element arranged parallel to the second edge of the base layer in a second orientation;

wherein the first orientation is orthogonal to the second orientation; and further wherein the plurality of rainscreen features create a plurality of fixed gaps or fluid channels therebetween.

2. The panel of claim 1, wherein the base layer comprises wood or engineered composite material.

3. The panel of claim 1, wherein the base layer comprises oriented strand board, fiberboard, particleboard, or plywood.

4. The panel of claim 1, wherein the at least one water resistant layer comprises a fluid or liquid-applied membrane of consistent thickness.

5. The panel of claim 1, wherein the at least one water resistant layer comprises an overlay.

6. The panel of claim 1, wherein the raised elements alternate in orientation.

7. The panel of claim 1, wherein the raised elements or ridges are up to ⅛ inch in height.

8. The panel of claim 1, wherein the raised elements or ridges are up to ¾ inch in height.

9. The panel of claim 1, wherein the plurality of rainscreen features are configured for stacking of the panel with other panels with no damage to the panel or the plurality of rainscreen features.

10. The panel of claim 1, wherein the plurality of rainscreen features are polymers.

11. The panel of claim 1, wherein the plurality of rainscreen features are arranged in a plurality of columns and a plurality of rows.

12. The panel of claim 11, wherein the plurality of rainscreen in a column have the same orientation.

13. The panel of claim 1, wherein the plurality of rainscreen elements occupy less of the outer surface than the plurality of fixed gaps or fluid channels.

* * * * *